US006227403B1

(12) United States Patent
Kim

(10) Patent No.: US 6,227,403 B1
(45) Date of Patent: May 8, 2001

(54) BEVERAGE CONTAINER

(76) Inventor: Jong-Ki Kim, No. 101-505, Taesan 1 group Apartment 886-83, Kosack-dong, Kwonsun-gu, Suwon-city, 441-360 Kyonggi-do (KR)

( * ) Notice: Subject to any disclaimer, the term of this patent is extended or adjusted under 35 U.S.C. 154(b) by 0 days.

(21) Appl. No.: 09/575,781

(22) Filed: May 22, 2000

(30) Foreign Application Priority Data

| | | |
|---|---|---|
| May 27, 1999 | (KR) | 99-9222 |
| Oct. 23, 1999 | (KR) | 99-22959 |
| Oct. 23, 1999 | (KR) | 99-46233 |
| Nov. 5, 1999 | (KR) | 99-24182 |

(51) Int. Cl.[7] ..... B65D 47/00

(52) U.S. Cl. ..... 220/707; 220/709; 220/710; 215/388

(58) Field of Search ..... 220/258, 710, 220/707, 705, 703, 709; 206/222; 215/388

(56) References Cited

U.S. PATENT DOCUMENTS

| | | | | |
|---|---|---|---|---|
| 5,005,717 | | 4/1991 | Oilar . | |
| 5,054,631 | * | 10/1991 | Robbins, III | 220/710 |
| 5,065,881 | * | 11/1991 | Tarng | 220/710 |
| 5,437,389 | * | 8/1995 | Kaufman et al. | 220/710 |
| 5,522,524 | * | 6/1996 | Nmngani | 220/710 |
| 5,671,863 | * | 9/1997 | Uliana | 220/710 |
| 5,687,872 | * | 11/1997 | Nmngani | 220/710 |

FOREIGN PATENT DOCUMENTS

| | | |
|---|---|---|
| 61-190463 | 8/1986 | (JP) . |
| 62-78069 | 4/1987 | (JP) . |
| 11-278524 | 10/1999 | (JP) . |
| 1992-4522 | 7/1992 | (KR) . |

* cited by examiner

*Primary Examiner*—Joseph M. Moy
(74) *Attorney, Agent, or Firm*—Jones, Tullar & Cooper, P.C.

(57) ABSTRACT

A beverage container is disclosed. The disclosed beverage container comprises a container provided with a receiving space for containing a beverage; a submerged straw submerged within the container, and provided with a blocking member of a thin foil; a flexible tube capable of being deformed elastically and installed at the container so as to communicate with the submerged straw; a sucking straw installed at one end of the flexible tube and provided with a perforating portion capable of penetrating the blocking member, when necessary, with the flexible tube compressed so as to communicate with the submerged straw; and a sealing means detachably coupled to a sucking portion of the sucking straw so as to protect the sucking portion of the sucking straw from external contaminants.

17 Claims, 13 Drawing Sheets

BEVERAGE CONTAINER

BACKGROUND OF THE INVENTION

1. Field of the Invention

The present invention relates to a beverage container, and more particularly, to a beverage container having an internally submerged straw, an external sucking straw and a flexible tube connecting these, which has a structure capable of keeping the end portion of the sucking straw clean and allowing a beverage contained in the beverage container to be drawn out with ease.

2. Description of the Related Art

In general, the beverage container has a closed receiving space for containing any one of various beverages. Generally, the beverage container is made of metal, paper, resin, or the like. A sealable drinking opening is formed at a predetermined position of the beverage container.

After the drinking opening is opened, the user can drink the beverage by contacting the drinking opening with his lips or by sucking the beverage through a separate straw inserted into the drinking opening. In the ways of drinking a beverage as described above, there is a disadvantage in that the beverage may be spilt undesirably or the user must carry a straw inconveniently.

This problem has been solved by Korean Patent No. 210109 entitled "Beverage container with self-contained straw", filed on Aug. 28, 1996 and issued on Apr. 23, 1999 to the applicant of the present invention. The beverage container disclosed in the patent has a straw assembly including a submerged straw, a sucking straw, and a flexible tube, instead of the drinking opening, and the user can drink the beverage conveniently with the straw assembly. Namely, in the beverage container disclosed in the patent, an orifice is provided at a portion of the top side of the container, and the submerged straw is installed within the container to extend from the orifice. The orifice is sealed with a thin foil such as an aluminum. The flexible tube is hermetically installed on the sealed orifice, and the sucking straw is connected to the flexible tube so that the sucking straw can penetrate the thin foil when the sucking straw is elected vertically and is pressed downward.

However, the disadvantage of the beverage container disclosed in the patent is that the sucking straw may become unhygienic since the sucking straw is exposed to the outside of the container, and, therefore, contaminants such as dust or foreign materials may adhere to the sucking straw. Further, another disadvantage of the patent is that it is difficult to continuously suck the beverage because of the pressure difference between atmosphere and the inside of the container. Furthermore, since the sucking straw is not completely fixed to the beverage container, the sealed portion between the flexible tube and the container may be damaged due to careless handling during the circulation of the beverage container.

SUMMARY OF THE INVENTION

To solve the above problems, it is an objective of the present invention to provide a hygienic beverage container having a structure capable of protecting a sucking straw from external contaminants.

It is another objective of the present invention to provide a beverage container having a structure allowing the beverage contained in the container to be easily drawn out from the container by forming an air hole allowing external air to flow into the beverage container when the user drinks the beverage.

It is still another objective of the present invention to provide a beverage container allowing the user to drink the beverage by means of a sucking straw or a drinking opening according to user's preference.

Accordingly, to achieve the first objective, there is provided a beverage container comprising: a container provided with a receiving space for containing a beverage; a submerged straw submerged within the container, and provided with a blocking member of a thin foil; a flexible tube capable of being deformed elastically and installed at the container so as to communicate with the submerged straw; a sucking straw installed at one end of the flexible tube and provided with a perforating portion capable of penetrating the blocking member, when necessary, with the flexible tube compressed so as to communicate with the submerged straw; and a sealing means detachably coupled to a sucking portion of the sucking straw so as to protect the sucking portion of the sucking straw from external contaminants.

To achieve the second objective, the container is provided with an air hole; and the cap member has a sealing portion capable of selectively sealing or opening the air hole.

To achieve the third objective, there is provided a beverage container comprising: a container having a closed receiving space for containing a beverage, and an attachment portion projected from the upper surface of the container while communicating with the receiving space; a submerged straw which is submerged in the container and the upper end of which hangs on the attachment portion; a sealing cover which detachably coupled to the attachment portion and at the center portion of which a blocking member of a thin foil is installed; a flexible tube capable of being deformed elastically and installed on the sealing cover so as to communicate with the submerged straw; a sucking straw installed at one end of the flexible tube and provided with a perforating portion capable of penetrating the blocking member, when necessary, with the flexible tube compressed so as to communicate with the submerged straw; and a cap member detachably coupled to a sucking portion of the sucking straw so as to protect the sucking straw from external contaminants.

BRIEF DESCRIPTION OF THE DRAWINGS

The above objectives and advantages of the present invention will become more apparent by describing in detail preferred embodiments thereof with reference to the attached drawings in which.

DESCRIPTION OF THE PREFERRED EMBODIMENTS

Figure 1:
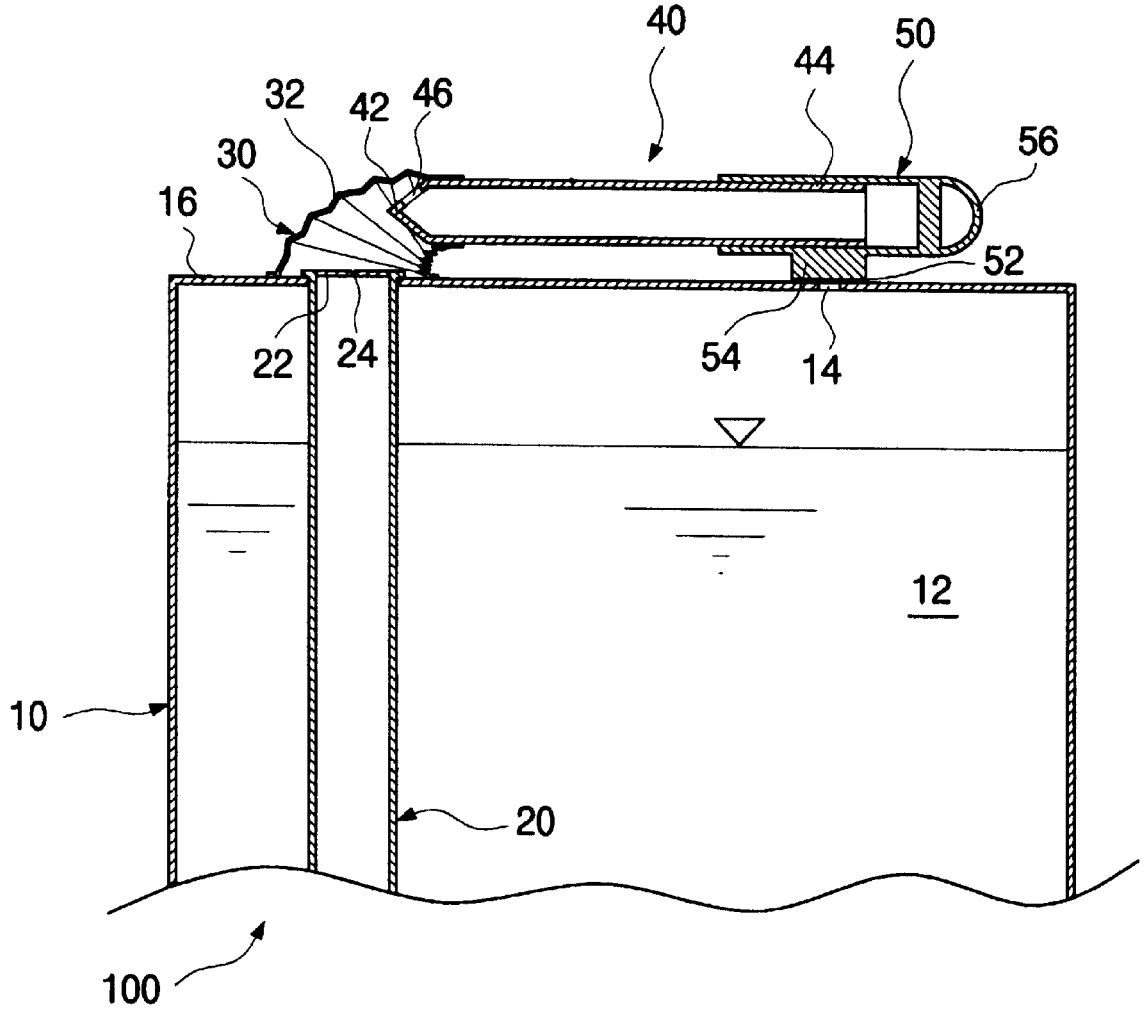
FIG. 1 is a cross-sectional view schematically illustrating a beverage container according to a first embodiment of the present invention.
Figure 2:
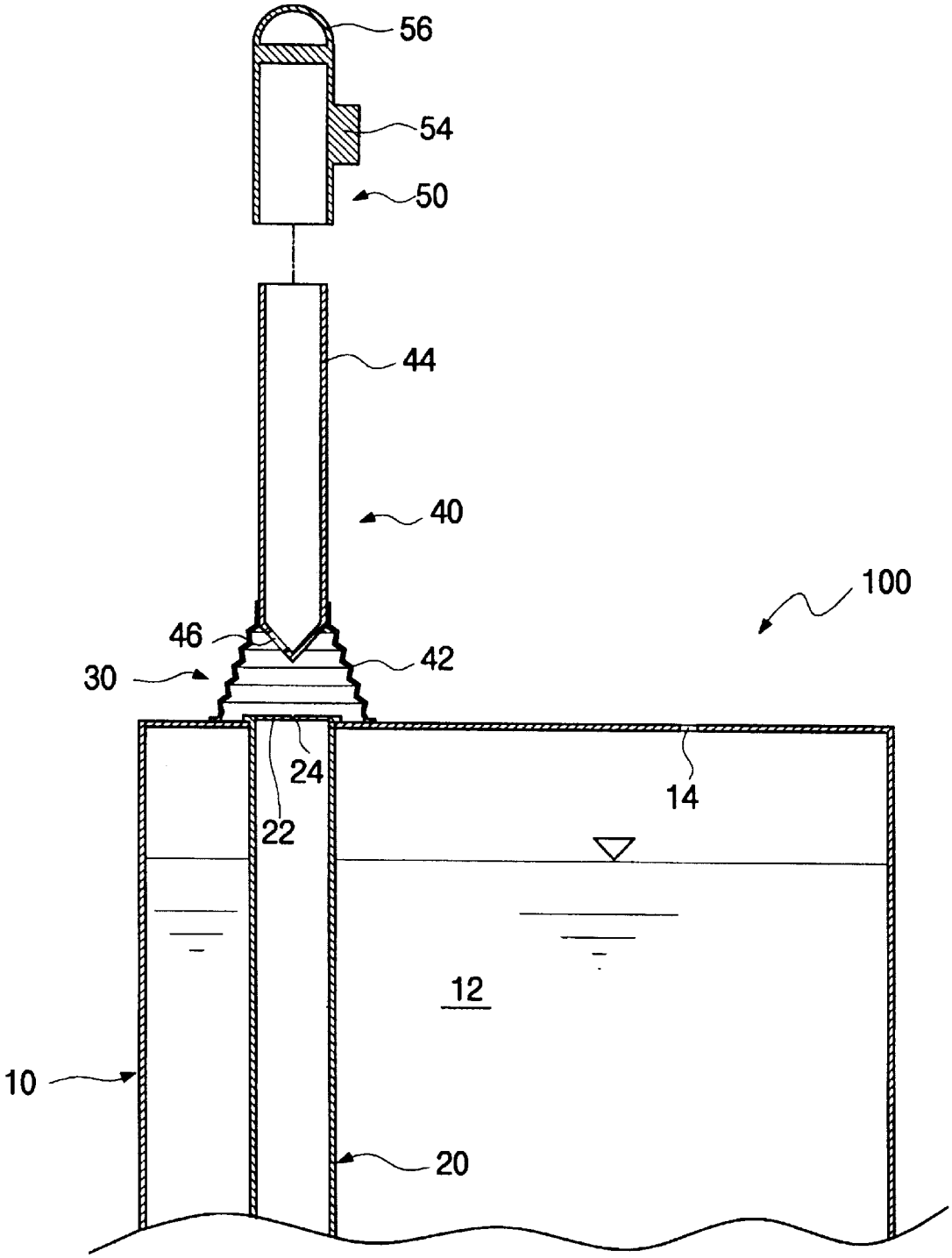
FIG. 2 is a cross-sectional view for describing a method of using the beverage container of FIG. 1.

FIG. 1 is a cross-sectional view schematically illustrating a beverage container according to a first embodiment of the present invention, and FIG. 2 is a cross-sectional view for describing a method of using the beverage container of FIG. 1.

Referring to FIGS. 1 and 2, a beverage container 100 according to a first embodiment of the present invention comprises a container body 10 which has a receiving space 12 for containing a beverage such as juice or water, a submerged straw 20 which is to be submerged in the container body 10 and at the upper end of which a blocking member 22 of a thin foil is hermetically installed, a flexible tube 30 installed on the container body 10 to communicate with the submerged straw 20, a sucking straw 40 installed at the upper portion of the flexible tube 30 to communicate with the submerged straw 20 when the sucking straw 40 is pressed downward and penetrates the blocking member 22 with the flexible tube 30 compressed, and a sealing means removably coupled to the sucking straw 40 for protecting the sucking straw 40 from external contaminants.

The container body 10 is made of metal, resin or paper, and has a conventional shape such as a cylindrical or hexahedral shape. An air hole 14 is formed at a predetermined position of the upper surface of the container body 10. The size and shape of the air hole 14 are such that external air may be sucked into the container body 10 when the user drinks the beverage.

The submerged straw 20 is inserted into a through hole formed at the upper surface of the container body 10, and made of a plastic material. The lower end of the submerged straw 20 is preferably located nearly close to the bottom of the container body 10. It is preferable that the blocking member 22 installed at the upper end of the submerged straw 20 is made of thin foil material such as aluminum foil or the blocking member 22 is integrally formed with the submerged straw 20 so that the beverage dose not flow out from the receiving space 12 during the handling of the beverage container 100 and it can be ruptured by a perforating portion 42 formed at the lower end of the sucking straw 40 when the user erects the sucking straw 40 and presses it downward so as to drink the beverage. The rupture portion 24, which has a groove in the form of a cross or arc on its center, is formed in the blocking member 22 so as to be ruptured easily by the perforating portion 42.

The flexible tube 30 has a structure in which the diameter of the flexible tube 30 is gradually increased from the lower end of the sucking straw 40 to the surface of the container body 10. Therefore, when the flexible tube 30 is bent, such a structure can prevent a side well 32 of the flexible tube 30 from being damaged by the perforating portion 42 of the sucking straw 40. The flexible tube 30, formed of a plastic material, has a known bellows structure. Therefore, the flexible tube 30 can be flexibly deformed in all direction. The lower end of the flexible tube 30 is installed on the surface of the container body 10, and the lower end of the sucking straw 40 is installed at the upper end of the flexible tube 30.

The perforating portion 42 of the sucking straw 40 is preferably constructed to have a conical shape, and a small hole 46 is formed at a predetermined position of the perforating portion 42 for providing a passageway of the beverage. The other end of the sucking straw 40 is a sucking portion 44 to be contacted by the user's lips. The sucking straw 40 is preferably made of the same material as the submerged straw 20.

The sealing means is intended to envelop the outer circumferential surface of the sucking portion 44 and to protect the sucking portion 44 from external contaminants such as dust and foreign materials which may contaminate the sucking portion 44 during the handling of the beverage container 100. In this embodiment, a cap member 50 into which the sucking portion 44 can be inserted is exemplified as a sealing means.

Preferably, the cap member 50 includes a sealing portion 54 to be adhered to the surrounding portion of the air hole 14 by an adhesive 52. The sealing portion 54 is intended to seal the air hole 14 after the beverage container 100 is filled with a beverage, and can be detached from the beverage container so as to open the air hole 14 when the user wants to drink the beverage. The sealing portion 54 is integrally formed with the cap member 50 and has a plate shape. The sealing portion 54 and cap member 50 are made of elastic materials. To easily grip the cap member 50, a ring 56 is provided at the end of the cap member 50.

A method of using the beverage container according to the first embodiment of the present invention will be described as follows.

As shown in FIG. 1, in the beverage container 100 as a finished product filled with a beverage, the sucking straw 40 is disposed to be laid on and be parallel to the upper surface of the container body 10 by bending the flexible tube 30 and attaching the cap member 50 to the surrounding portion of the air hole 14 with an adhesive. In addition, the cap member 50 is assembled to the sucking portion 44. Therefore, even if the beverage container 100 reaches an end user from a factory via various warehouses, external contaminants do not contaminate the sucking portion 44 of the sucking straw 50. Further, the sucking straw 40 and cap member 50 is not moved by a small external force since they are fixed to the upper surface 16 of the container body 10 by the adhesive 52.

In order to drink the beverage filled in the container 100, the user inserts his finger into the ring 56 of the cap member 50, and pulls the ring 56 upwardly to separate the sealing portion 54 from the air hole 14. Then, the sucking straw 40 and the submerged straw 20 are positioned in a straight line by the restoring force of the flexible tube 30.

Then, as shown in FIG. 2, after the cap member 50 has been separated from the sucking straw 40, the sucking straw 40 is moved toward the container body 10. And then, as the flexible tube 30 is compressed, the perforating portion 42 of the sucking straw 40 penetrates the blocking member 22 according to the pressure applied by the user. As a result, the sucking straw 40, the collapsible tube 30 and submerged straw 20 communicate with each other via the small hole 46, thereby forming a passageway for the beverage to flow out. In this state, when the user sucks the sucking portion 44 of the sucking straw 40, the beverage contained in the container body 10 can be drawn through the passageway, since external air can flow into the container body 10 through the air hole 14 during this process, the beverage is smoothly drawn out from the container body 10 by means of the sucking straw 40.

Figure 3:
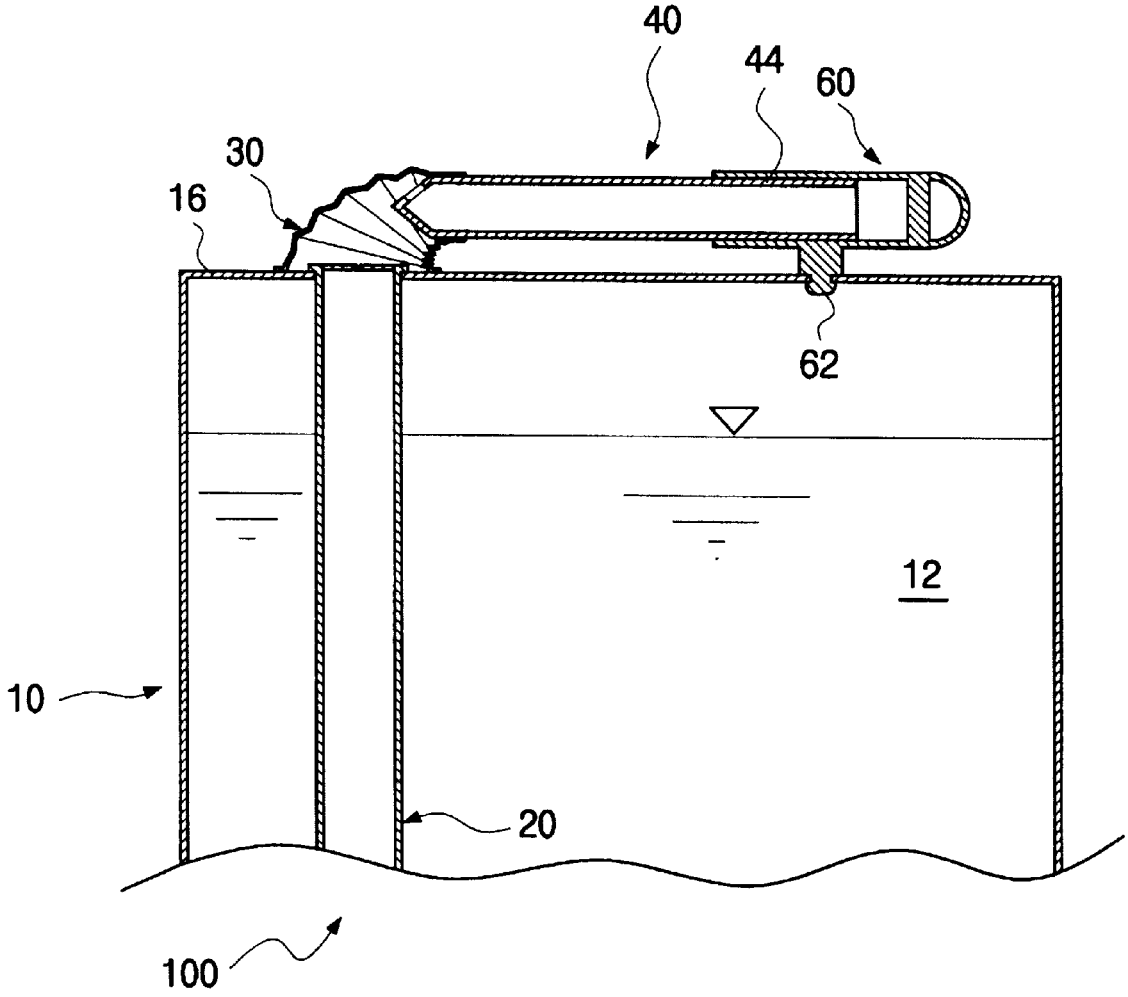
FIG. 3 is a cross-sectional view schematically illustrating a beverage container according to a second embodiment of the present invention.
Figure 4:
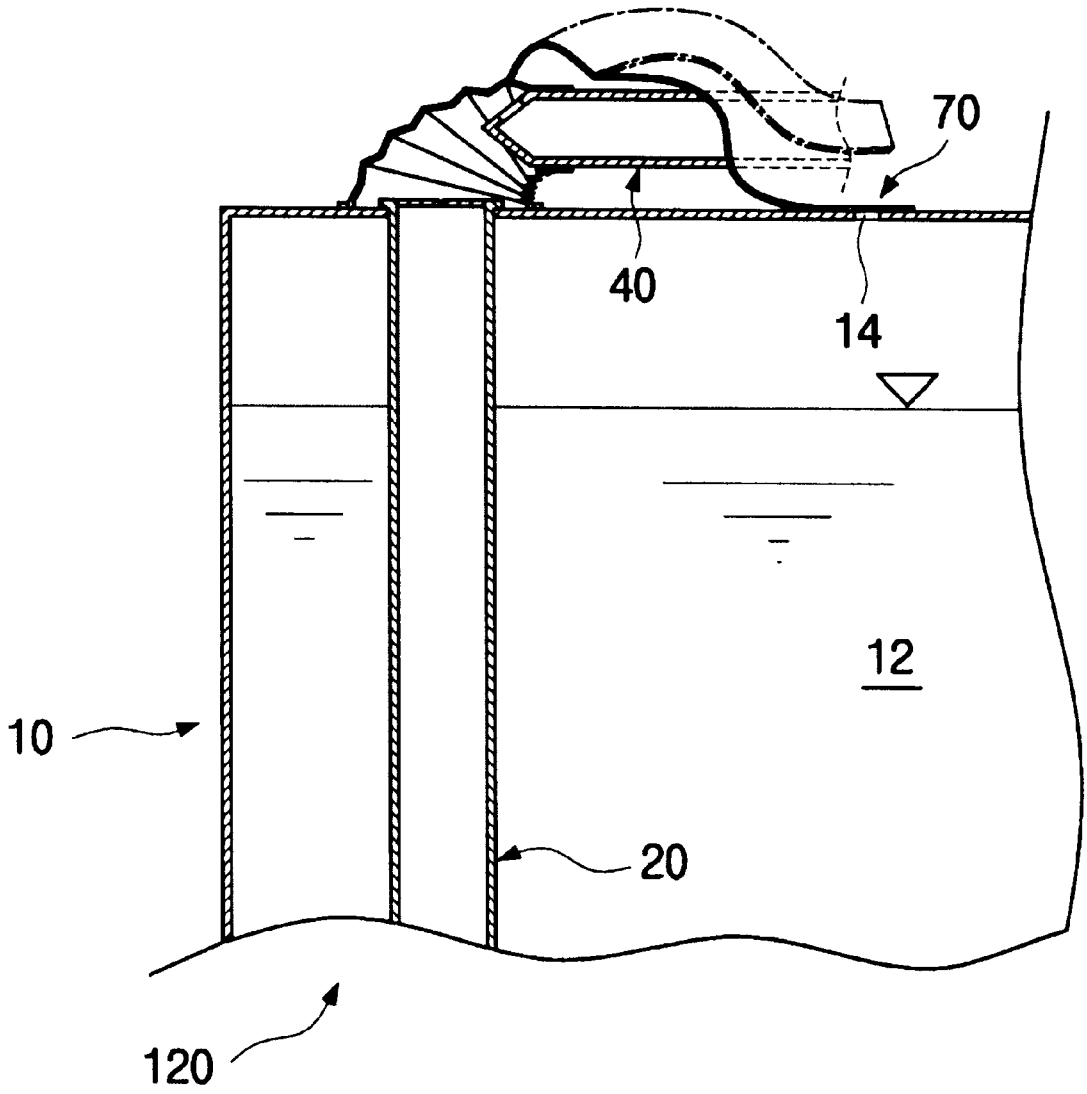
FIG. 4 is a cross-sectional view schematically illustrating a beverage container according to a third embodiment of the present invention.

FIGS. 3 and 4 are cross-sectional views schematically showing beverage containers according to the second and third embodiments of the present invention, respectively. The same reference numerals denote similar members having similar functions of FIG. 1.

Referring to FIG. 3, in the case of a beverage container 110 according to a second embodiment of the present invention, the beverage container 110 according to the second embodiment can be distinguished from the first embodiment by the shape of a sealing portion of a cap member 60. Namely, a packing member 62 which can be inserted into an air hole 14 is integrally formed with the cap member 60. The packing member 62 is made of elastic materials. In addition, its section is preferably I-shaped such that the upper and lower end can tightly contact the air hole 14 when the packing member 62 is inserted into the air hole 14. That is to say, the packing member 62 may be separated from the air hole when the user wants to drink the beverage, otherwise it may be inserted into the air hole. Accordingly, during the handling of the beverage container 110, the packing member 62 can prevent the beverage from flowing out of the container body 10.

Referring to FIG. 4, a beverage container 120 according to a third embodiment of the present invention can be distinguished from the first and second embodiments by the fact that the beverage container 120 further comprises a protecting cover 70 which is attached to the upper surface of a container body 10 by an adhesive (not shown) while enveloping a sucking straw 40 and sealing an air hole 14.

The protecting cover 70 is made of water-resistant material such as aluminum or resin so that when the protecting cover 70 is separated from the container body 10, the sucking straw 40 can be released from a fixed state and the air hole 14 can be opened, as shown in phantom lines of FIG. 4.

Figure 5:
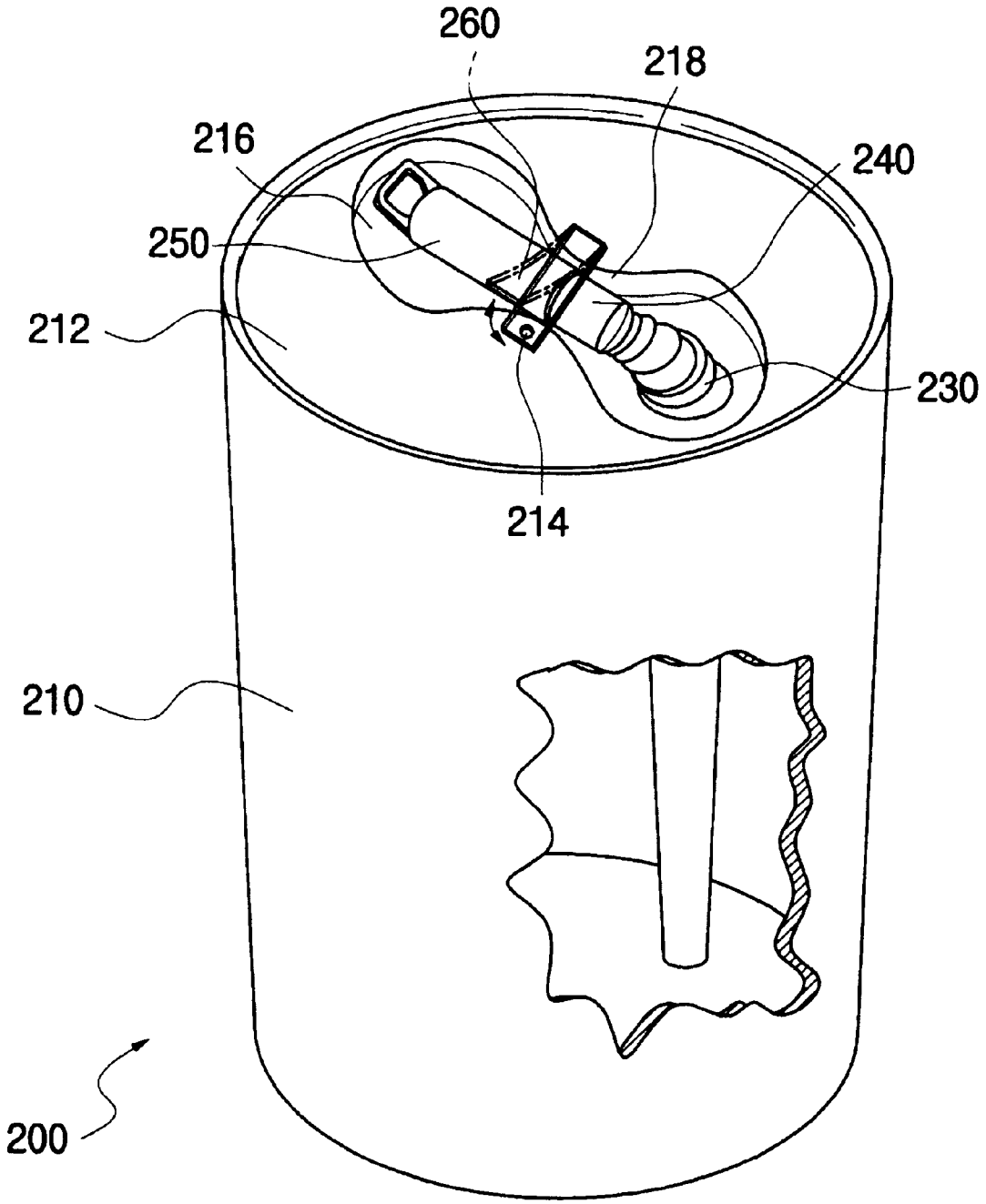
FIG. 5 is a perspective view schematically illustrating a beverage container according to a fourth embodiment of the present invention.
Figure 6:
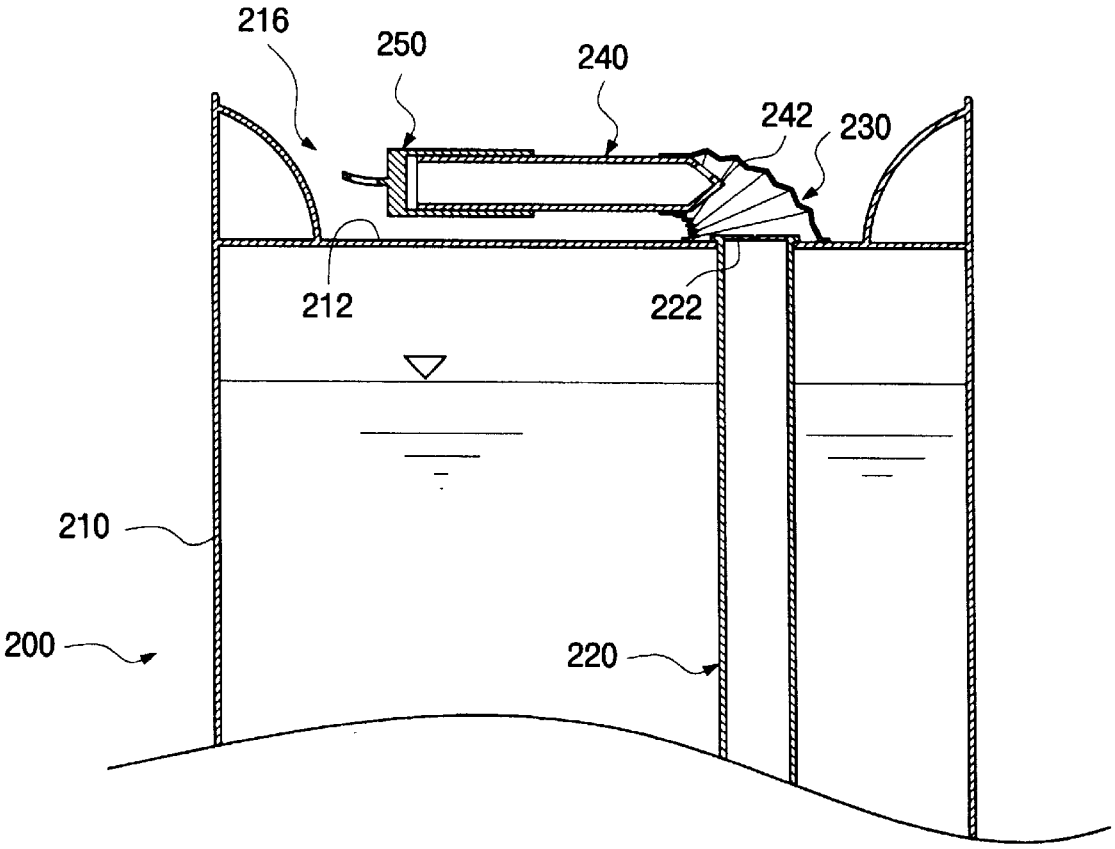
FIGS. 6 and 7 are cross-sectional views illustrating the beverage container of FIG. 5 in unused and used conditions, respectively.
Figure 7:
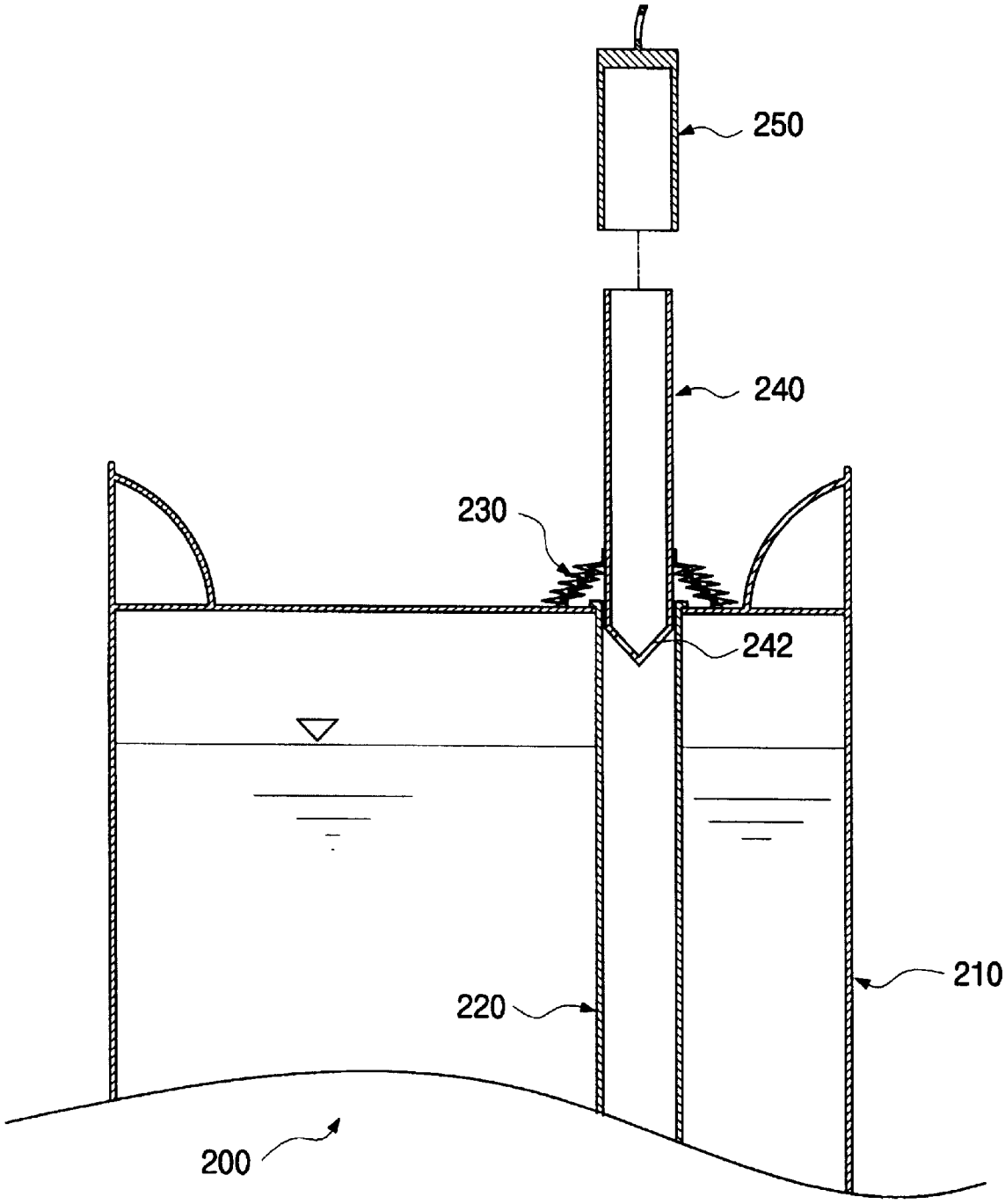

FIG. 5 is a perspective view of the beverage container according to a fourth embodiment of the present invention. FIGS. 6 and 7 are cross-sectional views showing the beverage container of FIG. 5 in unused and used conditions, respectively.

Referring to FIGS. 5 to 7, a beverage container 200 according to a fourth embodiment of the present invention has a structure in which the submerged straw 200 (FIG. 6) is positioned within a container body 210, a flexible tube 230 is installed on the upper surface 212 of the container body 210, and a sucking straw 240 is connected to the upper end of the flexible tube 230.

A receiving groove 216, a recessed groove having a predetermined shape, is formed on the upper surface 212 of the container body 210 so as to receive the sucking straw 240 and a cap member 250 when the sucking straw 240 and the cap member 250 are laid into the receiving groove 216 while the flexible tube 230 is deformed. The receiving groove 216 has a supporting portion 218 into which a portion of the cap member 250 is inserted so as to prevent the sucking straw 240 and the cap member 250 received in the receiving groove 216 from moving freely. That is, the supporting portion 218 has a width narrower than those of the other portions of the receiving groove 216. In addition, an air hole 214 is formed at the upper surface of the container body 210 at a position spaced a predetermined distance from the receiving groove 216. Therefore, the cap member 250 according to this embodiment serves only to prevent the sucking straw 240 from being contaminated by external contaminants, and, therefore, a separate protecting cover 260 serves to seal the air hole 214. The protecting cover 260 is attached, by an adhesive, to the upper surface of the container body 210 across the supporting portion 218.

Figure 8:
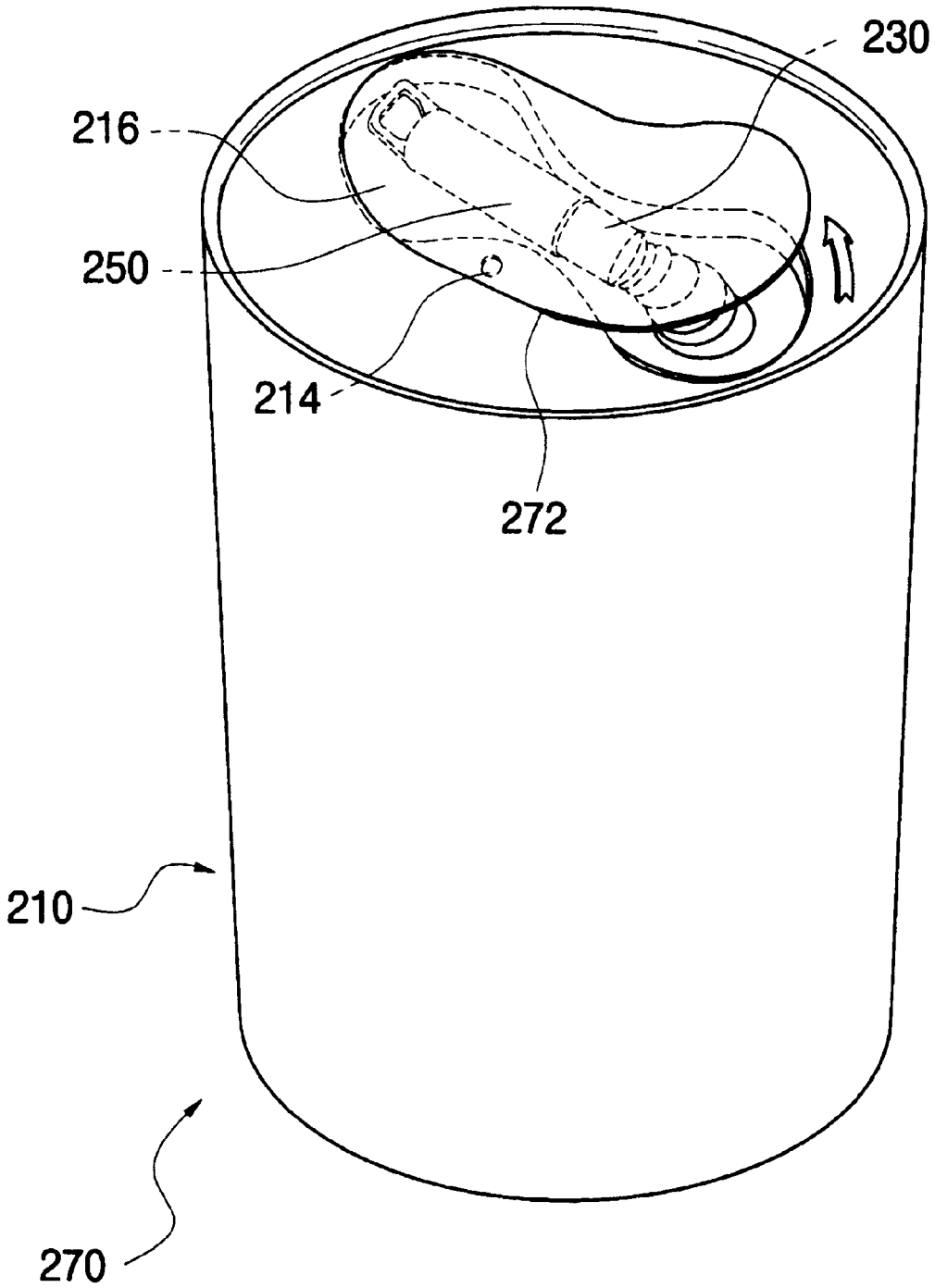
FIG. 8 is a perspective view schematically illustrating a beverage container according to a fifth embodiment of the present invention.

Furthermore, as shown in FIG. 8, which is a perspective view of a beverage container according to a fifth embodiment of the present invention, a beverage container 270 prevents a receiving groove 216 as well as a sucking straw 240 and a cap member 250 from being contaminated by external contaminants, and has a protecting cover 272 wider than the protecting cover 260 of the fourth embodiment so as to seal an air hole 214.

A method of using the beverage container according to the fourth embodiment of the present invention will be described as follows.

As shown in FIG. 5, in order to drink the beverage in the container 200 as a finished product, the user pulls upwardly the protecting cover 260 away from the container body 210, and then, opens the air hole 214. Thereafter, the user separates the cap member 250 from the sucking straw 240. In that case, as shown in FIG. 6, the sucking straw 240 are aligned with the submerged straw 220 in a straight line by the restoring force of the flexible tube 230. Then, as shown in FIG. 7, when the sucking straw 240 is moved downwardly, the perforating portion 242 penetrates the blocking member 222. As a result, the sucking straw 240 communicates with the submerged straw 220, and the user can freely drink the beverage in the container body 210.

Figure 9:
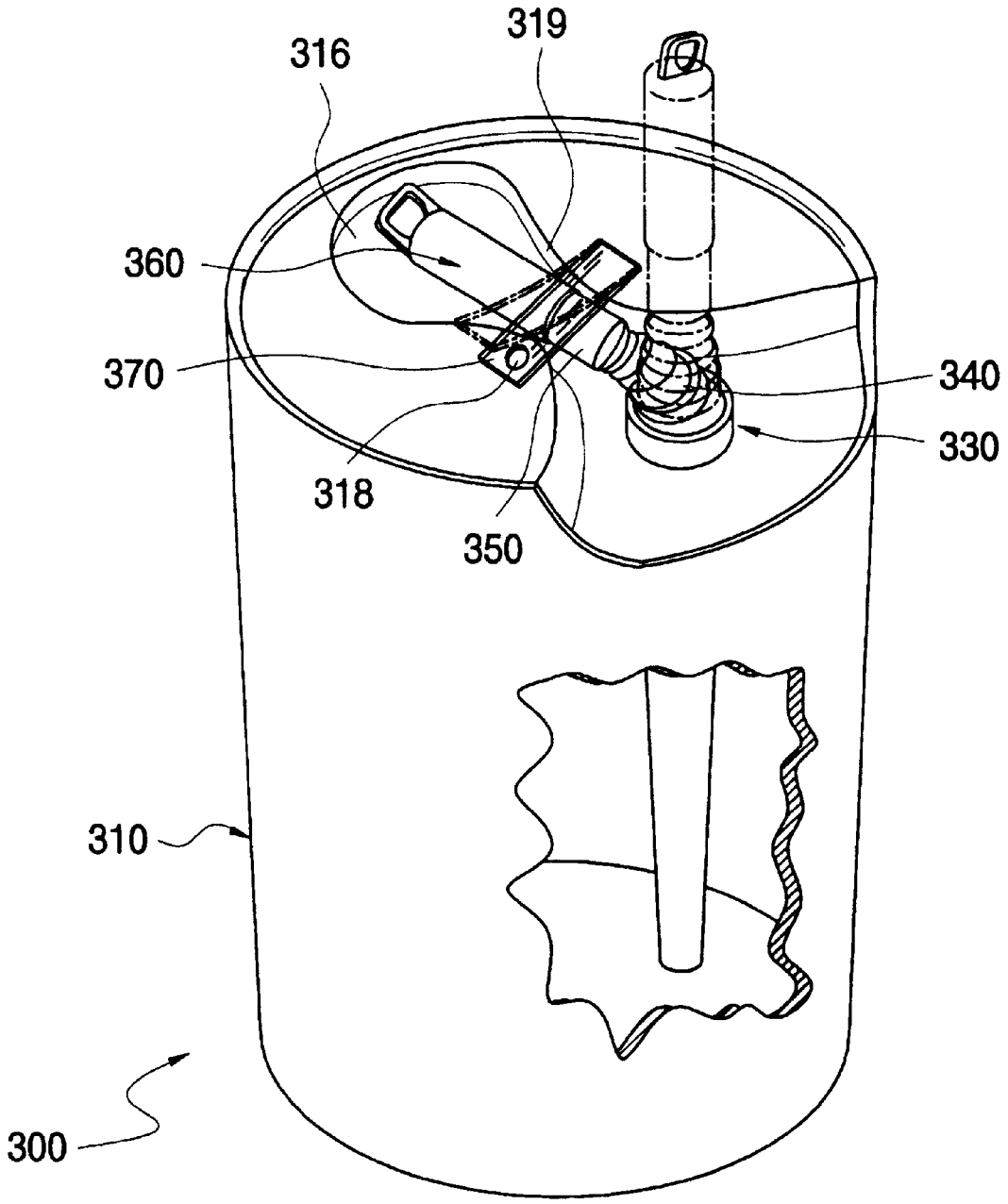
FIG. 9 is a perspective view schematically illustrating a beverage container according to a sixth embodiment of the present invention.
Figure 10:
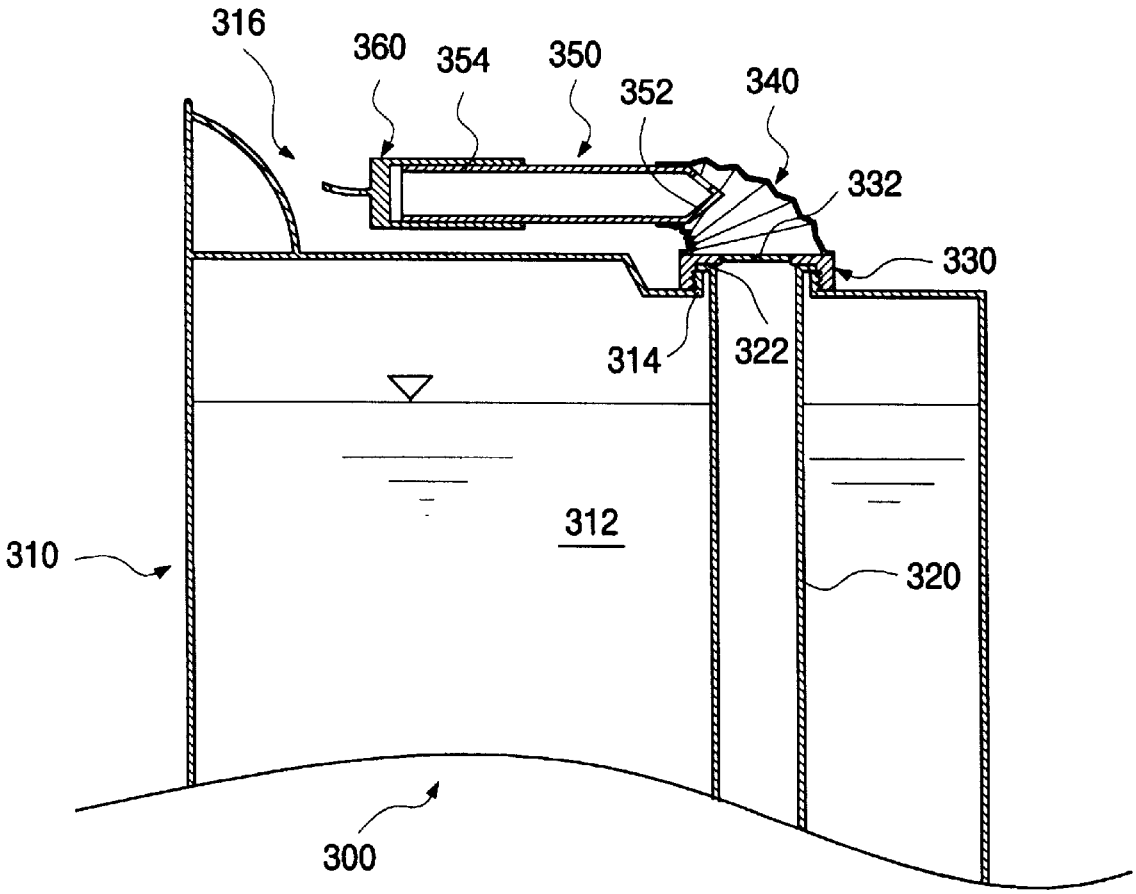
FIGS. 10 and 11 are cross-sectional views illustrating the beverage container of FIG. 9 in unused and used conditions, respectively.
Figure 11:
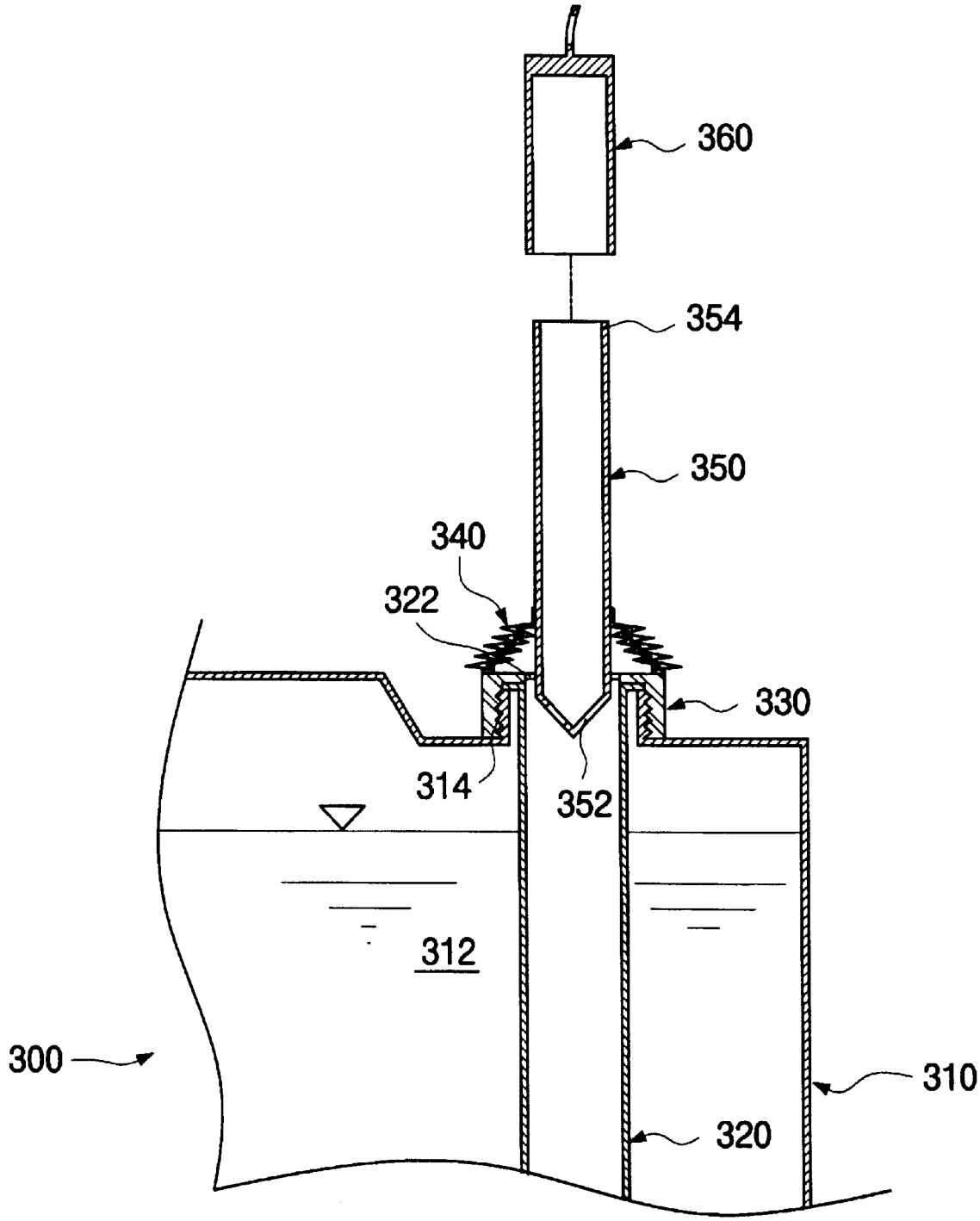

FIG. 9 is a perspective view of a beverage container according to a sixth embodiment of the present invention. FIGS. 10 and 11 are cross-sectional views showing the beverage container of FIG. 9 in unused and used conditions, respectively.

Referring to FIGS. 9 to 11, a beverage container 300 according to a sixth embodiment of the present invention comprises a container body 310 including a closed receiving space 312 for containing a beverage, and an attachment portion 314 upwardly projected from the container body 310 while communicating with the receiving space 312, a submerged straw 320 which is submerged in the container body 310 and the upper end of which hangs on the attachment portion 314, a sealing cover 330 selectively screwed on the attachment portion 314 and provided with a blocking member 332 of a thin foil, a flexible tube 340 installed on the sealing cover 330 to communicate with the submerged straw 320, a sucking straw 350 connected to the upper end of the flexible tube 340 and provided with a perforating portion 352, and a cap member 360 detachably coupled to a sucking portion 354 of the sucking straw 350.

With the structure of the beverage container 300 according to the sixth embodiment of the present invention, the user can drink the beverage included in the container in two different manners. One is to drink the beverage by using the sucking straw 350, and the other is to directly drink the beverage with his lips contacting the attachment portion 314 after detaching the sealing cover 330 from the attachment portion 314 without using the straw.

The attachment portion 314 is integrally formed with the container body 310. On the outer circumferential surface of the attachment portion 314 and the inner circumferential surface of the sealing cover 330, respective threads are provided so that the sealing cap 330 can be screwed on the attachment portion 314. The submerged straw 320 has a flange portion 322 so that the flange portion 322 can hang on the attachment portion 314. The blocking member 332 in the form of a thin foil is provided at the center portion of the sealing cover 330. However, the blocking member 332 may be provided at the upper end of the submerged straw 320. A receiving groove 316 is formed at the upper surface of the container body 310 to receive the sucking straw 350 when the sucking straw 350 is laid into the receiving groove 316 while the flexible tube 340 is deformed. In FIG. 9, reference numeral 318 denotes an air hole, and reference numeral 370 denotes a protecting cover.

The assembly sequence of the beverage container according to the sixth embodiment of the present invention will be described as follows.

First, the submerged straw 320 is positioned within the container body 310 so that the flange portion 322 of the submerged straw 320 can hang on the attachment portion 314. Subsequently, the sealing cover 330 provided with the sucking straw 350 and the flexible tube 340 is screwed on the attachment portion 314. In the assembled condition as above, the cap member 360 is coupled to the sucking portion 354 of the sucking straw 350, and the sucking straw 350 and the cap member 360 is supported by the supporting portion 319 after being laid down in the receiving groove 316.

Figure 12:
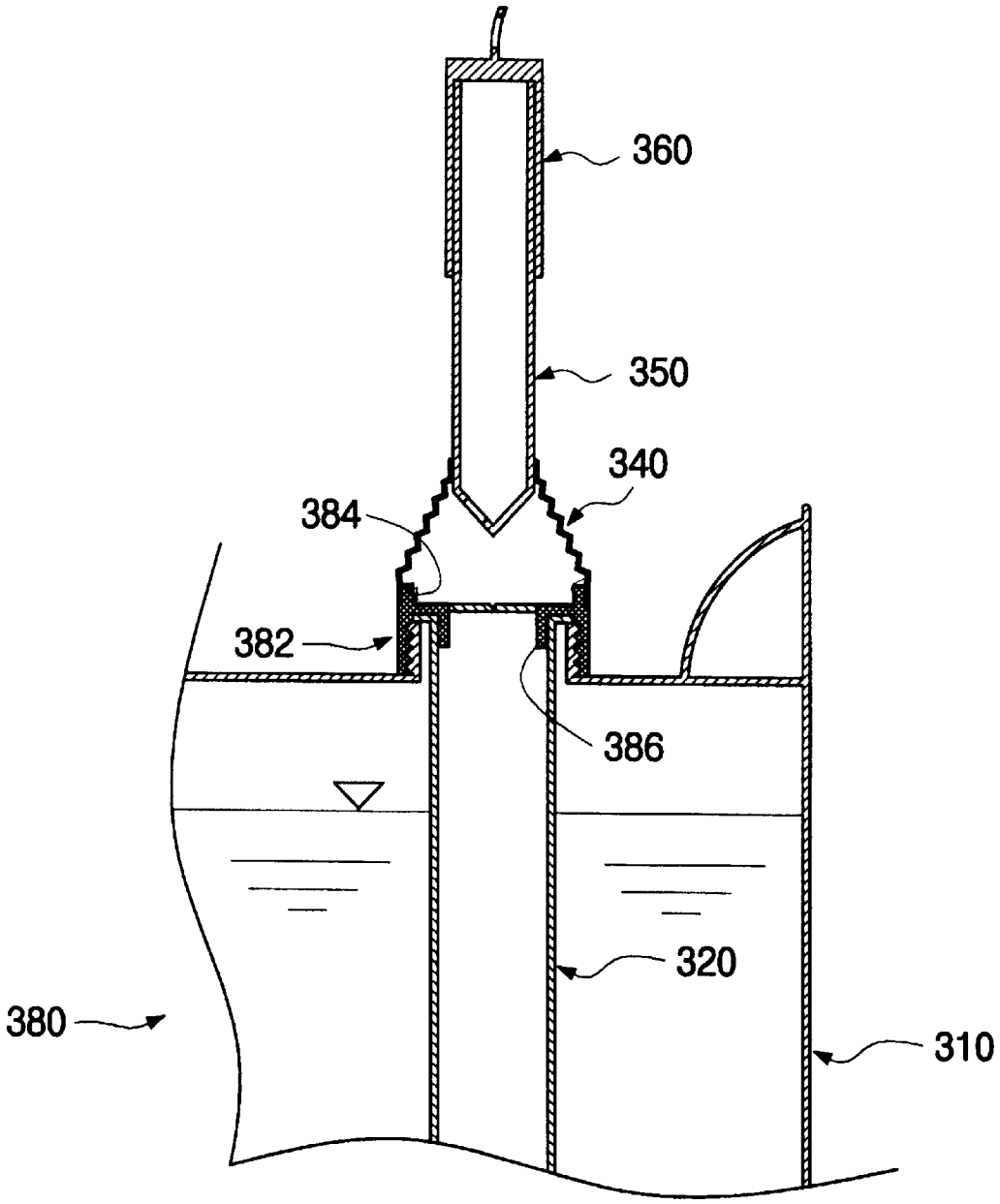
FIG. 12 is a cross-sectional view schematically illustrating a beverage container according to a seventh embodiment of the present invention.

FIG. 12 is a cross-sectional view of a beverage container according to a seventh embodiment of the present invention. The same reference numerals denote similar members having similar functions of FIGS. 9 to 11.

As shown in FIG. 12, in a beverage container according to a seventh embodiment, the structure of a sealing cover 382 is different from that of the sealing cover 330 of the sixth embodiment. That is to say, the sealing cover 382 has an upward cylindrical portion 384 and a downward cylindrical portion 386. The lower end of a flexible tube 340 is forcedly fitted on the outer circumferential surface of the upward cylindrical portion 384, and the upper end of the submerged straw 320 is forcedly fitted on the outer circumferential surface of the downward cylindrical portion 386. Therefore, the upward and downward cylindrical portions 384 and 386 are intended to facilitate the connections of the flexible tube 340 and the submerged straw 320 to a container body 310, and, therefore, the production cost of the beverage container can be lowered, and the productivity of the beverage containers can be enhanced.

Figure 13:
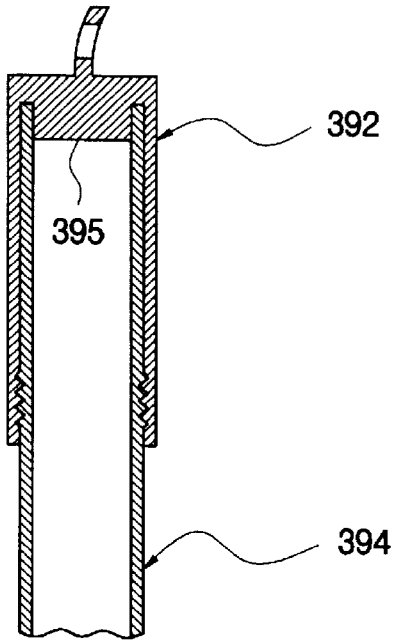
FIGS. 13 and 14 are cross-sectional views illustrating respective cap member portions according to eighth and ninth embodiments of the present invention.
Figure 14:
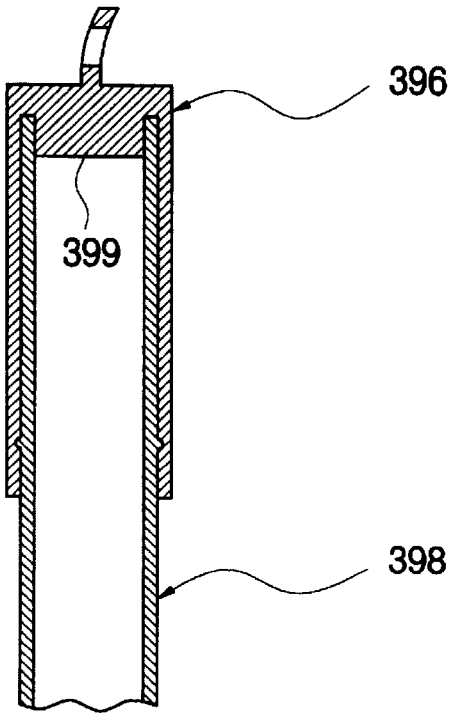

FIGS. 13 and 14 are cross-sectional views illustrating respective cap member portions according to eighth and ninth embodiments of the present invention.

As shown in FIG. 13, on the outer circumferential surface of a sucking straw 394 and the inner circumferential surface of a cap member 392, respective threads are provided so that the cap member 392 can be screwed on the sucking straw 394. As shown in FIG. 14, a cap member 396 and a sucking straw 398 are provided with an annular groove and an annular projection which can be engaged with each other, respectively. In addition, the projection and groove may be formed at opposite positions. However, it is preferable that the threads, projection and groove are formed at positions which are not touched by the user's lips.

As shown in FIGS. 13 and 14, inserting portions 395 and 399 are projected downwardly within the cap members 392 and 398, respectively, so that the respective upper ends of the sucking straws 394 and 398 can be forced fitted into the respective cap members 392 and 396 and can be sealed more tightly by the the respective cap members 392 and 396.

In the beverage containers according to the eighth and the ninth of embodiments, if the user does not want to drink all the beverage at one time, the user can again fit the cap member 392 or 396 on the sucking straw 394 or 398 so as to prevent the remaining beverage from being spilt accidentally.

The beverage container according to the present invention has the following effects.

First, the container can be maintained in a desired hygienic state since the cap member or protecting cover protects the sucking straw communicating with the inside of the container from ambient air.

Second, since the receiving groove is formed at the upper surface of the container for receiving the sucking straw and cap member, the sucking straw can be prevented from being moved by an external force and damaging other portions.

Third, since the air hole is formed at the upper surface of the container body, the user can drink the beverage with ease. Further, since the cap member is made in various forms and is attached to a position to seal the air hole, the cap member serves to keep the sucking straw being in a desired hygienic state, and serves to seal the air hole simultaneously.

Fourth, since the attachment portion is provided at the upper portion of the beverage container so as to communicate with the submerged straw, the sealing cover is detachably attached to the attachment portion, and the flexible tube and the sucking straw are provided on the sealing cover so as to communicate with the submerged straw, the user can drink the beverage directly or by means of the sucking straw according to his preference. Further, the construction of the beverage container is improved so that the production cost of the beverage container can be lowered, and the productivity of the beverage containers can be enhanced.

Fifth, since the cap member is screwed on the sucking straw, and the annular projection and groove are provided at the sucking straw and the cap member, the sucking straw can be sealed effectively by the cap member.

What is claimed is:

1. A beverage container comprising:

a container provided with a receiving space for containing a beverage;

a submerged straw submerged within the container, and provided with a blocking member of a thin foil;

a flexible tube capable of being deformed elastically and installed at the container so as to communicate with the submerged straw;

a sucking straw installed at one end of the flexible tube and provided with a perforating portion capable of penetrating the blocking member, when necessary, with the flexible tube compressed so as to communicate with the submerged straw; and a sealing means detachably coupled to a sucking portion of the sucking straw so as to protect the sucking portion of the sucking straw from external contaminants.

2. The beverage container according to claim 1, wherein the sealing means has a cap member to be fitted on the sucking portion.

3. The beverage container according to claim 2, wherein the container is provided with an air hole; and the cap member has a sealing portion capable of selectively sealing or opening the air hole.

4. The beverage container according to claim 3, wherein the sealing portion has a packing member capable of being inserted into the air hole.

5. The beverage container according to claim 1, wherein the sealing means includes a protecting cover attached to the container so as to protect the sucking portion of the sucking straw from external contaminants and so as to seal the air hole.

6. The beverage container according to claim 1, wherein the blocking member has a rupture portion having a predetermined shape so as to be ruptured by the perforating portion.

7. The beverage container according to claim 1, wherein the flexible tube has a structure in which the diameter of the flexible tube is gradually increased from the lower end of the sucking straw to the surface of the container body.

8. The beverage container according to claim 1, wherein the container further comprises a receiving groove formed on the surface of the container so as to receive the sucking straw when the sucking straw is laid into the receiving groove with the flexible tube deformed.

9. The beverage container according to claim 8, wherein the receiving groove has a supporting portion having a predetermined shape so as to prevent the sucking straw from moving freely.

10. The beverage container according to claim 3, wherein the container is provided with an air hole spaced a predetermined distance from the receiving groove; and the sealing means has a protecting cover capable of sealing both the receiving groove and the air hole so as to prevent the sucking straw from being contaminated by external contaminants.

11. A beverage container comprising:

a container having a closed receiving space for containing a beverage, and an attachment portion projected from the upper surface of the container while communicating with the receiving space;

a submerged straw which is submerged in the container and the upper end of which hangs on the attachment portion;

a sealing cover which detachably coupled to the attachment portion and at the center portion of which a blocking member of a thin foil is installed;

a flexible tube capable of being deformed elastically and installed on the sealing cover so as to communicate with the submerged straw;

a sucking straw installed at one end of the flexible tube and provided with a perforating portion capable of penetrating the blocking member, when necessary, with the flexible tube compressed so as to communicate with the submerged straw; and a cap member detachably coupled to a sucking portion of the sucking straw so as to protect the sucking straw from external contaminants.

12. The beverage container according to claim 11, wherein the container further comprises a receiving groove formed on the surface of the container so as to receive the sucking straw when the sucking straw is laid into the receiving groove with the flexible tube deformed.

13. The beverage container according to claim 12, wherein the sealing cover has an upward cylindrical portion on which the flexible tube is forcedly fitted; and a downward cylindrical portion on which the submerged straw is forcedly fitted.

14. The beverage container according to claim 11, wherein the cap member and the sucking straw are provided with respective threads, and the cap member is screwed on the sucking straw.

15. The beverage container according to claim 11, wherein the cap member and the sucking straw are provided with a projection and a groove which can be engaged with each other, respectively.

16. The beverage container according to claim 14, wherein the cap member further comprises an inserting portion which is forcedly fitted into the upper end of the sucking straw so as to seal the sucking portion of the sucking straw.

17. The beverage container according to claim 15, wherein the cap member further comprises an inserting portion which is forcedly fitted into the upper end of the sucking straw so as to seal the sucking portion of the sucking straw.

* * * * *